United States Patent [19]

Lovett

[11] 4,424,928

[45] Jan. 10, 1984

[54] SHOE SUPPORT FOR HEEL ATTACHING MACHINE

[75] Inventor: Albert E. Lovett, Melton Mowbray, England

[73] Assignee: USM Corporation, Farmington, Conn.

[21] Appl. No.: 356,897

[22] Filed: Mar. 10, 1982

[30] Foreign Application Priority Data

Mar. 11, 1981 [GB] United Kingdom ..... 8107637

[51] Int. Cl.[3] ..... A43B 21/36; A43D 69/02

[52] U.S. Cl. ..... 227/28; 227/140; 227/148

[58] Field of Search ..... 227/28, 29, 119, 148, 227/140

[56] References Cited

U.S. PATENT DOCUMENTS

| | | | |
|---|---|---|---|
| 3,018,051 | 1/1962 | Homstreet | 364/801 |
| 3,831,014 | 8/1974 | Haid | 364/844 |
| 3,961,173 | 6/1976 | Perry et al. | 364/802 |
| 4,000,410 | 12/1976 | Hentschel et al. | 364/802 |
| 2,353,815 | 10/1973 | Fed. Rep. of Germany | 364/806 |
| 1,419,914 | 8/1974 | U.S.S.R. | 364/806 |
| 2,475,629 | 10/1975 | U.S.S.R. | 364/806 |
| 3,494,751 | 8/1976 | U.S.S.R. | 364/806 |
| 4,636,636 | 4/1977 | U.S.S.R. | 364/802 |
| 5,691,886 | 10/1979 | U.S.S.R. | 364/806 |

FOREIGN PATENT DOCUMENTS 5442 of 1904 United Kingdom ..... 227/148

OTHER PUBLICATIONS

"Transistor Heat Sink Calculations," by Myron Greenbaum, Electronics, vol 33, No. 32; Aug. 1960, pp. 36, 66, 68.

*Primary Examiner*—Paul A. Bell
*Assistant Examiner*—James Wolfe
*Attorney, Agent, or Firm*—Donald N. Halgren

[57] ABSTRACT

A shoe support for supporting a shoe to have a heel attached thereto comprises a generally planar support surface against the heel seat region of the shoe and the heel are located. The support has at least one nail guide formed therein which is inclined to the normal to the support surface and contains a pusher member movable normally to the support surface. A driver rests on the pusher member and is movable, by movement of the pusher member, along the guide to drive a nail therefrom into the heel seat region and the heel. As the pusher member moves sliding movement takes place, normally to the direction of movement of the pusher member, between the pusher member and the driver.

10 Claims, 5 Drawing Figures

SHOE SUPPORT FOR HEEL ATTACHING MACHINE

BACKGROUND OF THE INVENTION (1) Field of the Invention

This invention is concerned with a shoe support for supporting a shoe to have a heel attached thereto in a heel attaching machine. Such shoe supports comprise a generally planar support surface in the shape of the heel seat region of a shoe and against which the heel seat region can be located. Such supports also have nail guides formed therein which open through the support surface. In the use of such supports, nails are located in the nail guides, the heel seat region is then located on the support surface, and a heel is located on the opposite side of the heel seat region to the support surface. Next, nails which have been positioned in the nail guides are driven into the heel seat region and the heel, to attach the heel to the shoe, by movement of drivers in the nail guides.

(2) Prior Art

When the heel to be attached tapers, it is desirable that some or all of the nails are driven at an inclination to the normal to the heel seat region so that the nail or nails so driven enter the heel inclined towards the center of the heel and there is less chance of the nails approaching the surface of the heel and possibly deforming it. In order to achieve this inclined drive while yet keeping the support sufficiently narrow to enable the leg portions of boots to be passed over the support, various complicated and hence expensive to manufacture arrangements have been proposed, for example the use of flexible drivers in curved nail guides.

It is an object of the present invention to provide a shoe support in which at least one nail can be driven at an inclination to the normal to the heel seat region and which is of simple construction.

SUMMARY OF THE INVENTION

The invention provides a shoe support for supporting a shoe to have a heel attached thereto in a heel attaching machine, the support comprising a generally planar support surface against which the heel seat region of a shoe can be located so that a nail can be driven through the heel seat region into a heel positioned thereon to attach the heel to the shoe, a pusher member movable within the support normally to the support surface, a nail guide formed in the support and opening through the support surface, the nail guide being inclined to the normal to the support surface so that a nail can be located in the guide to be driven into the heel seat region and the heel at an inclination to the normal to the heel seat region, and a driver movable in the nail guide, one end portion of the driver resting on the pusher member and an opposite end portion of the driver being engageable with a nail positioned in the nail guide so that movement of the driver in the nail guide causes the nail to be driven as aforesaid, wherein movement of the pusher member causes said movement of the driver along the nail guide, the arrangement being such that during movement of the pusher member relative sliding movement takes place, normally to the direction of movement of the pusher member, between the pusher member and the driver.

In order to enable a number of nails to be driven into the heel seat region and the heel, in a shoe support according to the last preceding paragraph, a plurality of pusher members are movable within the support normally to the support surface and each pusher member engages one or more drivers which are movable in nail guides formed in the support, so that movement of the pusher members causes movement of the drivers in the guides and nails to be driven from the guides into the heel seat region and the heel.

In order to reduce the total force acting on the heel seat region and the heel while the nails are being driven, in a shoe support according to the last preceding paragraph, each pusher member is arranged to be moved normally to the support surface by an individual moving arrangement therefor and the moving arrangements are arranged to operate one-after-the-other so that, in the operation of the support, nails may be driven into the heel seat region and the heel one or two at a time.

DESCRIPTION OF THE DRAWINGS

There now follows a detailed description, to be read with reference to the accompanying drawings, of a shoe support which is illustrative of the invention. It is to be understood that the illustrative shoe support has been selected for description by way of example and not of limitation of the invention.

In the drawings.

DESCRIPTION OF THE PREFERRED EMBODIMENT

Figure 1:
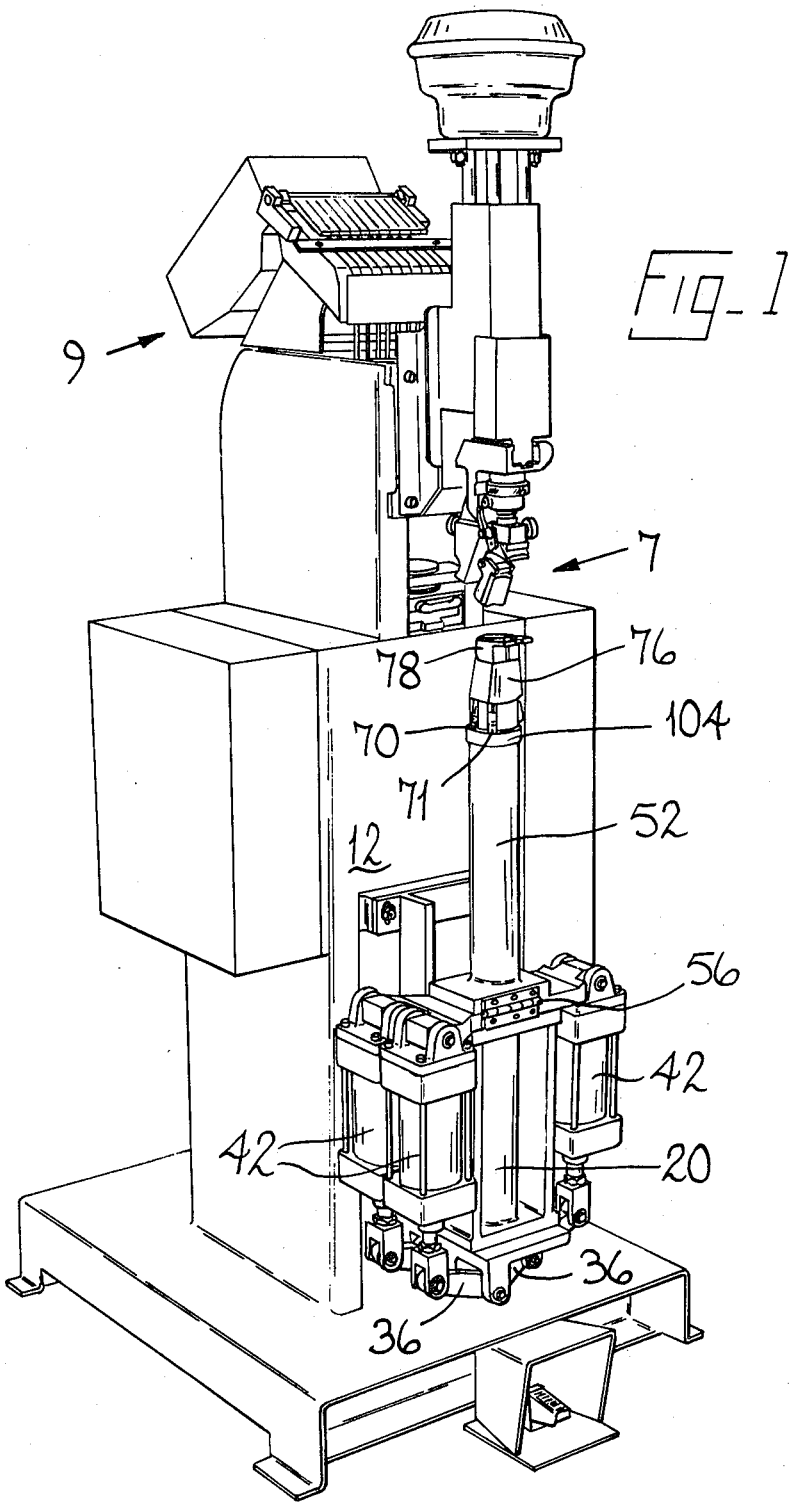
FIG. 1 is a front perspective view of a heel attaching machine of which the illustrative shoe support forms part.

The heel attaching machine shown in FIG. 1 comprises the illustrative shoe support for supporting a shoe to have a heel attached thereto in the heel attaching machine, a clamping means 7 which is operable to clamp a heel against the heel seat region of a shoe supported by the shoe support, and a nail loading means 9 operable to load nails into the nail guides of the shoe support.

Figure 5:
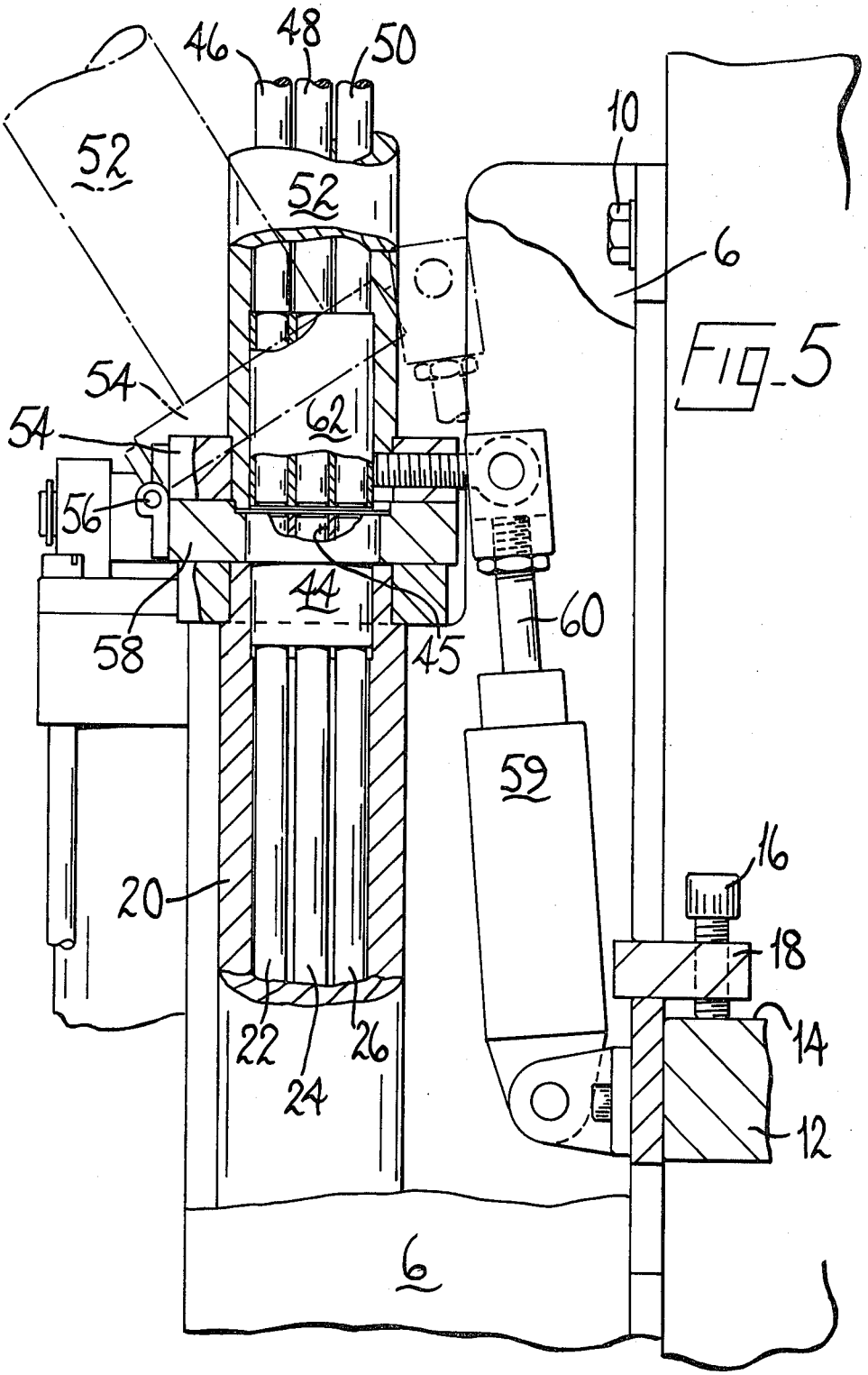
FIG. 5 is a generally sectional view taken on the line V—V in FIG. 2.

The illustrative shoe support comprises a frame 6 which is provided with an arrangement of slots 8 through which the frame 6 can be bolted by a plurality of bolts 10 to a support column 12 of the heel attaching machine. The support column 12 has a horizontal surface 14 (FIG. 5) which is engaged by two adjusting screws 16 which are set in a horizontal bar 18 of the frame 6. The screws 16 can be used to make final adjustments to the height of the frame 6 on the support column 12.

Figure 2:
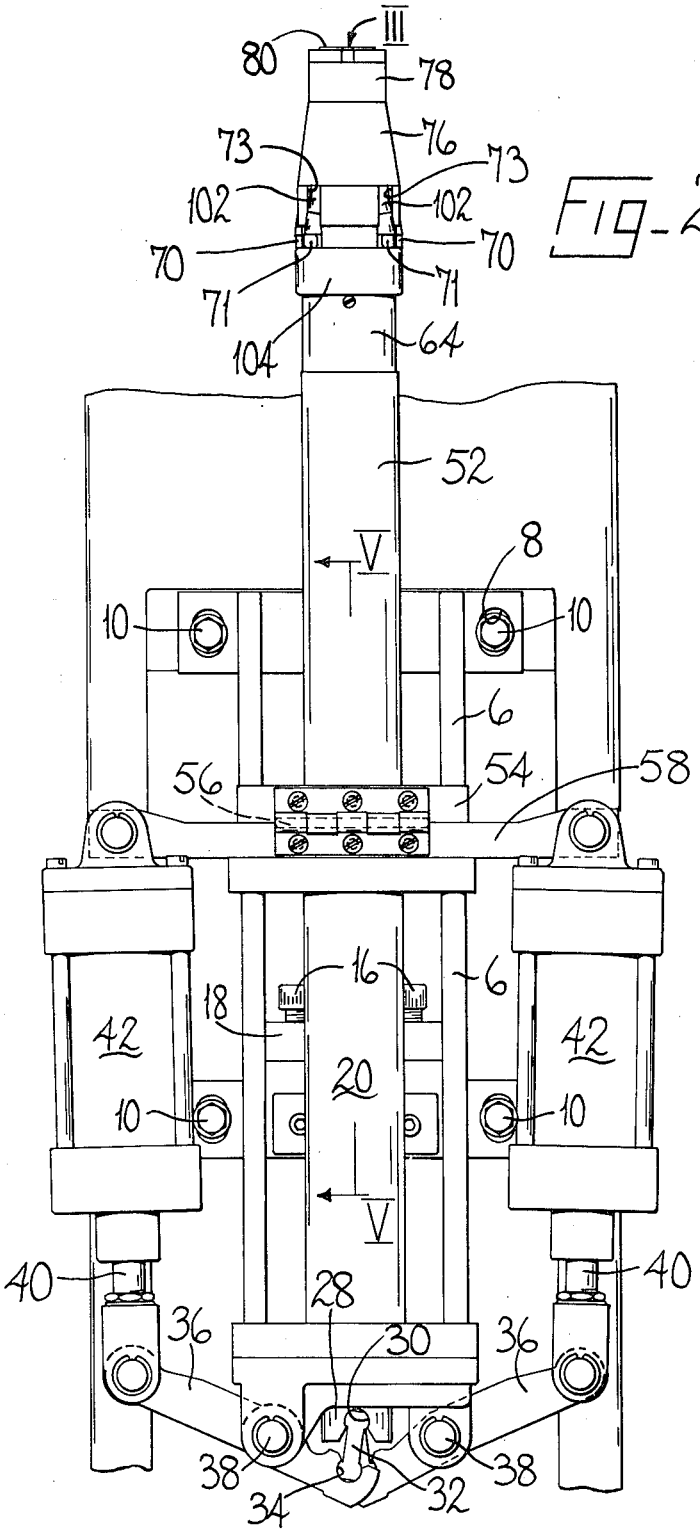
FIG. 2 is a front elevational view, on a larger scale than FIG. 1, of the illustrative shoe support.

The frame 6 supports a vertically-extending hollow cylinder 20 within which an arrangement of three parallel cylindrical rods 22, 24 and 26 (FIG. 5) are positioned side by side. A lower end portion of each of the rods 22, 24 and 26 is secured to a block 28 (FIG. 2), the three blocks 28 being slidable on one another and are movable in a lower end portion of the cylinder 20. Each block 28 has a cylindrical groove 30 in a lower portion thereof in which a cylindrical end portion of a pivot member 32 is received. Each pivot member 32 has a further cylindrical end portion which is received in a cylindrical groove 34 in an end portion of a lever 36. The three levers 36 are mounted on the frame 6 of pivoting movement about pivots 38 and are each pivotally connected to a piston rod 40 of one of an arrangement of three piston and cylinder assemblies 42, two of the piston and cylinder assemblies 42 being supported by the frame 6 to the left of the cylinder 20 (viewing FIG. 2) and the third piston and cylinder assembly 42, that which is connected via the rod 40, the lever 36, the pivot member 32 and the block 28 to the central rod 24, being supported by the frame 6 to the right of the cylinder 20. The arrangement is such that operation of any of the three piston and cylinder assemblies 42 is effective to move its associated rod 22, 24 or 26 longitudinally within the cylinder 20.

Upper end portions of the rods 22, 24 and 26 are each received in vertical bores 45 extending through a guide member 44 (FIG. 5) supported within an upper end portion of the cylinder 20. The upper ends of the rods 22, 24 and 26 are arranged to abut respectively the lower ends of an array of three parallel cylindrical rods 46, 48 and 50 which are positioned side by side within a vertically extending hollow cylinder 52. The cylinder 52 has an external lower flange 58 which is hinged by a hinge 56 to an external upper flange 54 of the cylinder 20. A piston and cylinder assembly 59 is pivotally mounted on the frame 6 and has a piston rod 60 which is pivotally connected to the external lower flange 58 of the cylinder 52. Operation of the piston and cylinder assembly 59 is effective to move the cylinder 52 and parts associated therewith (including the rods 46, 48 and 50) about the hinge 56 between an operative position (shown in full in FIG. 5) and a loading position (shown in broken line in FIG. 5). The lower end portions of the rods 46, 48 and 50 extend through bores in a guide member 62 which is supported within a lower end portion of the cylinder 52, the lower end portions of the rods 46, 48 and 50 being of smaller diameter than the remainder of these rods so that the guide member 62 acts to retain the rods 46, 48 and 50 within the cylinder 52. When the cylinder 52 is in the loading position thereof the rods 46, 48 and 50 are out of contact with the rods 22, 24 and 26 but, when the cylinder 52 is in its operative position, the rods 46, 48 and 50 abut respectively the rods 22, 24 and 26 so that longitudinal movement of the rods 22, 24 and 26 caused by operation of the piston and cylinder assemblies 42 causes longitudinal movement of the rods 46, 48 and 50.

Figure 4:
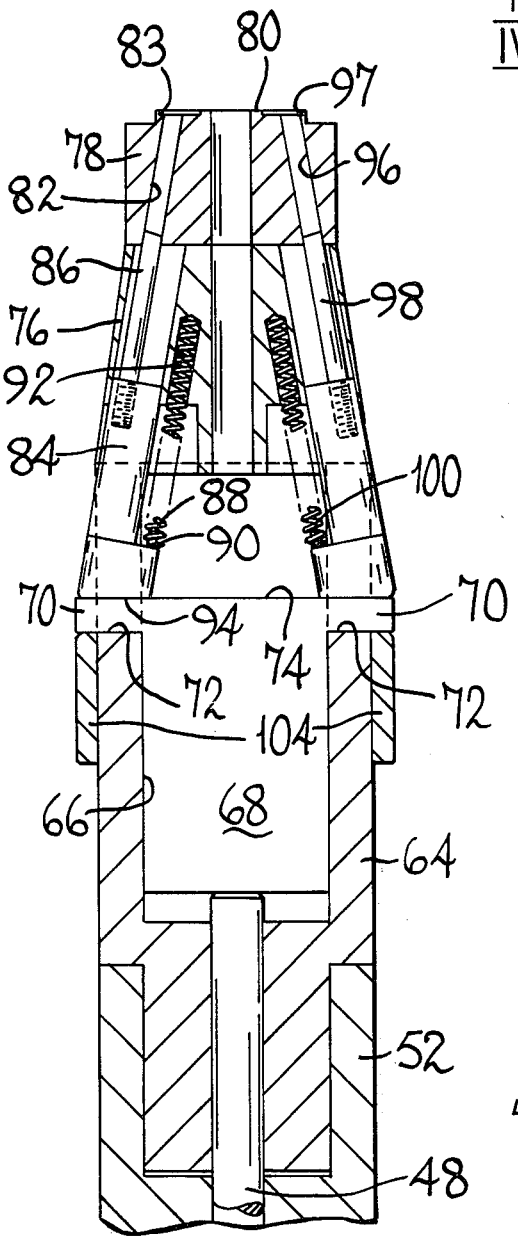
FIG. 4 is a sectional view taken on the line IV—IV in FIG. 3.

The upper end of the cylinder 52 supports a guide member 64 (FIG. 4) which is plugged into the upper end of the cylinder 52. The three rods 46, 48 and 50 pass through cylindrical bores in the guide member 64 and enter a cylindrical recess 66 therein. Within the recess 66, the central one 48 of the rods 46, 48 and 50 engages a pusher member 68 so that longitudinal movement of the rod 48 causes corresponding longitudinal movement of the pusher member 68. The pusher member 68 has a pair of sideways projections 70 which extend into and are each movable along a slot 72 formed in the guide member 64. The pusher member 68 is generally rectangular in transverse cross section (not shown) and has a flat upper surface 74. The remaining two rods 46 and 50 also engage pusher members within the recess 66. These two pusher members are not shown in the drawings but they have sideways projections 71 similar to the projections 70 extending into further slots 73 in the guide member 64. The three pusher members are slidable relative to one another within the recess 66 when caused to do so by longitudinal movement of the rods 46, 48 and 50.

Mounted on top of the guide member 64 is a block 76 and mounted on top of the block 76 is a block 78. The block 78 has a generally planar upper surface 80 which provides a support surface against which the heel seat region of a shoe can be located. The pusher member 68 is movable within the guide member 64 normally to the support surface 80 and, as will appear later, this movement is effective to cause nails to be driven through the heel seat region into a heel positioned thereon to attach the heel to the shoe.

A cylindrical nail guide 82 is formed within the blocks 76 and 78. This nail guide 82 has an upper portion formed in the block 78 and a lower portion of larger diameter formed in the block 76. The nail guide 82 opens through the support surface 80 within a recess 83 in the surface 80 and is inclined to the normal to the support surface 80. In the operation of the heel attaching machine, a nail can be located in the guide 82, by the nail loading means 9, to be driven into the heel seat region and the heel at an inclination to the normal to the heel seat region. A cylindrical driver 84 is movable in the nail guide 82 with a bottom end portion thereof resting on the surface 74 of the pusher member 68. An opposite, upper, end portion 86 of the driver 84 is of the same diameter as the portion of the nail guide 82 formed in the block 78 and is engageable with a nail positioned so that portion of the nail guide 82 so that movement of the driver 84 in the nail guide 82 causes the nail located therein to be driven as aforesaid. The arrangement is such that, during movement of the pusher member 68, relative sliding movement takes place, normally to the direction of movement of the pusher member 68, between the pusher member 68 and the driver 84. The driver 84 is provided with a return spring 88 which serves to maintain the driver 84 in contact with the surface 74. The spring 88 acts between a shoulder 90 of the driver 84 and a bore 92 formed in the block 76. The inclination of the nail guide 82 and hence of the driver 84 to the normal to the support surface 80 is arranged to be between 15 and 7 degrees, in the case of the illustrative shoe support the inclination is 10 degrees. The lower portion of the driver 84 projects into one of the slots 72 in the guide member so that it rests on top of the sideways projections 70 of the pusher member 68. The bottom surface 94 of the driver 84 is angled so that it conforms to the surface 74 of the pusher member 68. Thus, in the operation of the support, when the pusher member 68 is moved upwardly by movement of the rod 48 which has been in turn moved by the action of the piston and cylinder assembly 42 associated therewith, the pusher member urges the driver 84 upwardly in the nail guide 82 and causes the nail located in the nail guide 82 to be driven into the heel seat region and heel of the shoe.

A further nail guide 96 similar to the guide 82 is formed in the blocks 78 and 76 and contains a driver 98 which is similar to the driver 84. The further nail guide 96 also opens through the support surface 80 in a recess 97 therein and is inclined to the normal to the support surface 80. The inclination of the nail guide 96 is also 10 degrees to the normal to the support surface 80 but on the opposite side of said normal so that the two nail guides 82 and 96 approach one another as they approach the support surface 80. Like the driver 84, the driver 98 is movable in the nail guide 96 and the driver 98 rests on the pusher member 68, extending into the other slot 72 in the guide member 64 and resting on top of the other sideways projection 70 of the pusher member 68 so that movement of the pusher member 68 causes movement of both the drivers 84 and 98 and two nails, one from each nail guide 82 and 96, to be driven into the heel seat region and the heel. The driver 98 also has a return spring 100 similar to the spring 88 associated therewith.

Figure 3:
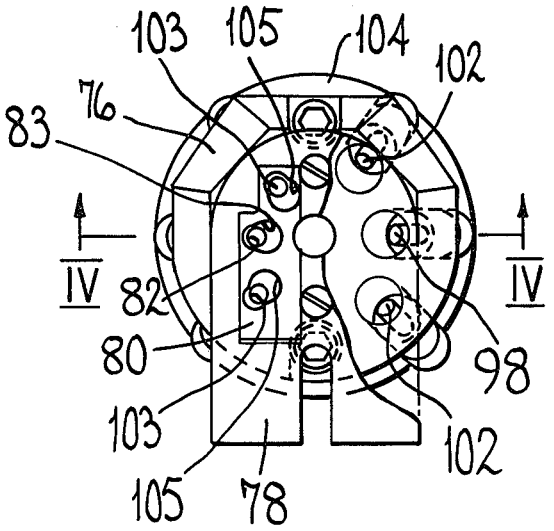
FIG. 3 is a plan view with parts broken away taken in the direction of the arrow III in FIG. 2.

The two remaining parallel cylindrical rods 46 and 50 also enter the recess 66 and engage pusher members (not shown) within the recess. These further pusher members are slidable within the recess relative to the pusher members 68 and have sideways projections 71 similar to the projections 70 of the pusher member 68 which enter slots 73 formed in the guide member 64. Longitudinal movement of the rods 46 and 50 is effective to move the further pusher members normally to the surface 80 and the upper surfaces of the further pusher members engage further drivers 102 which are movable in further nail guides 103 formed in the support which open into recesses 105 in the surface 80. The further nail guides 103 are similar to the nail guides 82 and 96 and the further drivers 102 are similar to the drivers 86 and 98 so that movement of the further pusher members causes movement of the further drivers 102 in the nail guides 103 and nails to be driven from the guides into the heel seat region and the heel. The illustrative support thus has a plurality of pusher members which engage two drivers to drive two nails into the heel seat region and the heel. However, in modifications of the illustrative support, one or more of the pusher members may only drive one nail depending on the pattern of nails that it is desired to drive into the heel seat region and the heel. The six nail guides of the illustrative support are arranged so that they extend radially of a central point located above the support surface 80 so that the nails driven from the nail guides approach one another (see FIG. 3).

As described above, each of the pusher members of the illustrative support is arranged to be moved normally to the support surface 80 by an individual moving arrangement therefor (comprising the piston and cylinder assembly 42, the lever 36, and the rods 22, 24 or 26 and 46, 48 and 50). In the illustrative support, these moving arrangements are arranged to operate one-after-the-other so that, in the operation of the illustrative support, nails are driven into the heel seat region and the heel two at a time. However, in the previously mentioned modification to the illustrative support, the nails may be driven one or two at a time.

In order to enable an operator of the illustrative support to check whether nails have been correctly loaded into the nail guides by the nail loading means 9, a ring 104 surrounds the guide member 64 and is movable upwardly thereon to engage the projections 70 and 71 of the three pusher members. The arrangement is such that, by moving the ring 104 upwardly, an operator of the illustrative support can move all three pusher members upwardly and thus all six drivers of the illustrative support so that nails in the nail guides become readily visible to the operator.

In the operation of the illustrative support, the nail loading means 9 is used to load nails into the six nail guides 82, 96 and 103 where the nails rest on the drivers 84, 98 and 102. Next, if the shoe to have a heel attached thereto is a high-legged boot, the piston and cylinder assembly 59 is operated to move the cylinder 52 and associated parts into the loading position thereof. Next, an operator of the illustrative support, positions the shoe with its heel seat region on the support surface 80. If the piston and cylinder 59 has been operated, it is now operated again to return the cylinder 52 and associated parts to their operative position. The operator next positions the heel to be attached to the shoe on the heel seat region, on the opposite side thereof to the support surface 80, and uses the clamping means 7 to clamp the heel in position. Next, the piston and cylinder assemblies 42 are operated in any desired order to cause the nails to be driven into the heel seat region and the heel.

It will be appreciated that the illustrative shoe support allows nails to be driven at an inclination to the normal to the heel seat region and is of simple construction having no connections between the drivers and the pusher members.

I claim:

1. A shoe support for supporting a shoe to have a heel attached thereto in a heel attaching machine, the support comprising:

a generally planar support surface against which the heel seat region of a shoe can be located so that a nail can be driven through the heel seat region into a heel positioned thereon to attach the heel to the shoe;

a pusher member movable within the support normally to the support surface;

a nail guide formed in the support and opening through the support surface, the nail guide being inclined to the normal to the support surface so that a nail can be located in the guide to be driven into the heel seat region and the heel at an inclination to the normal to the heel seat region;

a driver movable in the nail guide, one end portion of the driver resting on the pusher member and an opposite end portion of the driver being engageable with a nail positioned in the nail guide so that movement of the driver in the nail guide causes the nail to be driven as aforesaid, wherein movement of the pusher member causes said movement of the driver along the nail guide, the arrangement being such that during movement of the pusher member, relative sliding movement takes place normally to the direction of movement of the pusher member, between the pusher member and the driver; and wherein each pusher member is arranged to be moved normally to the support surface by an individual moving arrangement therefor and the moving arrangements are arranged to operate one-after-the-other so that in the operation of the support, nails are driven into the heel seat region and the heel one or two at a time.

2. A shoe support according to claim 1 wherein the nail guide is inclined to the normal to the support surface at an angle of between 15 and 7 degrees.

3. A shoe support according to claim 2 wherein a further nail guide is formed in the support, the further nail guide also opening through the support surface and being inclined to the normal to the support surface, a further driver is movable in the further nail guide, and the further driver rests on the pusher member so that movement of the pusher member causes movement of both drivers and two nails, one from each nail guide, to be driven into the heel seat region and the heel.

4. A shoe support according to claim 3 wherein the two nail guides approach one another as they approach the support surface.

5. A shoe support according to claim 4 wherein a plurality of pusher members are movable within the support normally to the support surface and each pusher member engages one or more drivers which are movable in nail guides formed in the support, so that movement of the pusher members causes movement of the drivers in the guides and nails to be driven from the guides into the heel seat region and the heel.

6. A shoe support according to claim 5 wherein the nail guides extend radially of a central point located above the support surface.

7. A shoe support according to claim 6 wherein each moving arrangement comprises a rod one of whose end portions engages the pusher member so that longitudinal movement of the rod causes movement of the pusher member normally of the support surface.

8. A shoe support according to claim 7 wherein each moving arrangement comprises a piston and cylinder assembly operable to move the rod longitudinally thereof, the piston of the assembly being connected to the rod via a lever mounted for pivoting movement about a fixed point.

9. A shoe support according to claim 8 wherein a portion of the support is pivotally movable to move the support surface between a loading position in which a heel seat region of a shoe can be located thereon and an operative position in which a heel can be attached to the shoe as aforesaid.

10. A heel attaching machine comprising a shoe support according to claim 9, including clamping means operable to clamp a heel in position on the heel seat region of a shoe located on the support surface of the shoe support, and nail loading means operable to load nails into the nail guide or nail guides of the shoe support prior to the heel seat region of the shoe being located on the support surface thereof.

* * * * *